US010227986B2

(12) United States Patent
Van Dam et al.

(10) Patent No.: US 10,227,986 B2
(45) Date of Patent: Mar. 12, 2019

(54) PUMPING SYSTEM FOR A WELLBORE AND METHODS OF ASSEMBLING THE SAME

(71) Applicant: General Electric Company, Schenectady, NY (US)

(72) Inventors: Jeremy Daniel Van Dam, West Coxsackie, NY (US); Scott Mordin Hoyte, Oklahoma City, OK (US)

(73) Assignee: General Electric Company, Schenectady, NY (US)

( * ) Notice: Subject to any disclaimer, the term of this patent is extended or adjusted under 35 U.S.C. 154(b) by 177 days.

(21) Appl. No.: 14/104,358

(22) Filed: Dec. 12, 2013

(65) Prior Publication Data

US 2015/0167657 A1 Jun. 18, 2015

(51) Int. Cl.

| | |
|---|---|
| ***F04D 13/14*** | (2006.01) |
| ***F04D 25/06*** | (2006.01) |
| ***F04D 29/08*** | (2006.01) |
| ***F04D 13/10*** | (2006.01) |
| ***F04D 13/12*** | (2006.01) |
| ***E21B 43/12*** | (2006.01) |

(52) U.S. Cl.

CPC ..... *F04D 13/14* (2013.01); *E21B 43/128* (2013.01); *F04D 13/10* (2013.01); *F04D 13/12* (2013.01); *F04D 25/0686* (2013.01); *F04D 29/086* (2013.01)

(58) Field of Classification Search

CPC .... E21B 43/121; E21B 43/126; E21B 43/128; F04D 13/12; F04D 13/14; F04D 25/06; F04D 25/0686; F04D 29/08; F04D 29/086; F04B 23/04; F04B 23/08; F04B 23/10; F04B 23/12; F04B 23/14; F04B 41/06; F04B 25/06; F04B 25/0686

USPC ..... 417/203, 205, 216, 223, 429

See application file for complete search history.

(56) References Cited

U.S. PATENT DOCUMENTS

| | | | | | |
|---|---|---|---|---|---|
| 2,775,204 | A | * | 12/1956 | Batten et al. | F04C 11/00 192/48.9 |
| 3,741,298 | A | * | 6/1973 | Canton | E21B 43/128 137/565.33 |
| 4,591,320 | A | * | 5/1986 | Pope | F04B 47/08 417/390 |
| 4,678,404 | A | | 7/1987 | Lorett et al. | |
| 4,981,175 | A | | 1/1991 | Powers | |

(Continued)

FOREIGN PATENT DOCUMENTS

| | | | |
|---|---|---|---|
| EP | 0644333 | B1 | 12/1998 |
| RU | 2469181 | C1 * | 12/2012 |
| RU | 2478832 | C1 * | 4/2013 |

*Primary Examiner* — Kenneth J Hansen
*Assistant Examiner* — Chirag Jariwala
(74) *Attorney, Agent, or Firm* — GE Global Patent Operation

(57) ABSTRACT

A pumping system for use in moving a fluid present within a well casing and through a production tubing is provided. The pumping system includes a housing coupled to the production tubing. The pumping system further includes a first pump coupled to the housing and having a first flow capacity and a second pump coupled to the housing and having a second flow capacity. The second flow capacity is different than the first flow capacity. A motor is coupled to the first pump and the second pump, wherein the motor is configured to selectively operate at least one of the first pump and the second pump based on a flow capacity of the fluid present within the well casing.

9 Claims, 6 Drawing Sheets

(56) References Cited

U.S. PATENT DOCUMENTS 5,296,153 A * 3/1994 Peachey ..... B04C 5/00 166/265
5,375,656 A 12/1994 Wilson
6,033,567 A * 3/2000 Lee ..... B01D 17/0217 166/265
6,082,452 A * 7/2000 Shaw ..... B04C 5/00 166/105.5
6,155,792 A * 12/2000 Hartley ..... F04B 47/06 165/119
6,250,390 B1 6/2001 Narvaez et al.
6,547,003 B1 * 4/2003 Bangash ..... E21B 43/40 166/106
6,860,726 B2 * 3/2005 Carter, III ..... B64D 41/00 417/319
7,051,815 B2 * 5/2006 Ireland ..... E21B 43/121 166/105.1
7,409,997 B2 * 8/2008 Gay et al. ..... E21B 43/128 166/105
7,617,919 B2 11/2009 Nett et al.
7,828,530 B2 11/2010 Queirel
7,934,547 B2 * 5/2011 Milkovisch ..... E21B 49/10 166/105
8,021,129 B2 9/2011 Traylor et al.
8,196,667 B2 * 6/2012 Ocalan ..... E21B 43/128 166/105
8,393,874 B2 3/2013 Zazovsky et al.
2011/0024123 A1 * 2/2011 Brown et al. ..... E21B 43/128 166/369
2012/0211240 A1 * 8/2012 Xiao et al. ..... E21B 34/10 166/372

* cited by examiner

PUMPING SYSTEM FOR A WELLBORE AND METHODS OF ASSEMBLING THE SAME

BACKGROUND

The embodiments described herein relate generally to pumping systems, and more particularly, to methods and systems for selectively pumping a fluid, under a range of flow rates, out of a well casing of a wellbore based on a production fluid present in the well casing.

In producing petroleum and other useful fluids from production wells, some well assemblies include submersible pumping systems for raising the fluids collected in the well. Production fluids enter the well casing via perforations formed in the well casing adjacent a geological formation. Fluids contained in the geological formation collect in the well casing and may be raised by the submersible pumping system to a collection point above the surface of the earth.

Conventional pumping systems include a submersible pump, a submersible electric motor and a motor protector. The submersible electric motor typically supplies power to the submersible pump by a drive shaft, and the motor protector serves to isolate the motor from the well fluids. A deployment system, such as deployment tubing in the form of tubing strings, can be used to deploy the submersible pumping system within a wellbore. Generally, power is supplied to the submersible electric motor or motors by one or more power cables supported along the deployment system.

The rate at which fluids flow from the geological formation to the well casing can change significantly over time. In particular, hydrocarbons contained in shale formations are known to flow at decreasing rates over time. Conventional production wells may provide a high rate of fluid production in the early phase of the well life; and may provide a lower rate of fluid production for the remainder of the well life due to lower levels of available fluid. For example, it is common for fluid production from shale formations to drop to $1/6^{th}$ of the initial production rate after 5 years. Producing the well at an efficient recovery rate may require the installation of an initial pumping system having a high flow rate in the early phase of well life and then replacing the initial pumping system with another pumping system having a lower flow rate one or more times over the life of the well. The temporal length of high rate production may be brief while requiring a costly high flow rate pumping system. Further, replacing pumping systems over the life of the well may increase design, operational, and/or maintenance costs of the well assembly.

Moreover, some well assemblies may pump fluid from two or more reservoirs that are present in the production formation by running separate submersible pumping systems deployed on separate tubing strings. Separate pumping systems, however, may be difficult to install and/or operate due to space constraints of the wellbore since the wellbore may need a diameter to accommodate separate pumping systems. Moreover, separate pumping systems may increase design, operational, and/or maintenance costs of the well.

BRIEF DESCRIPTION

In one aspect, a pumping system for use in moving a fluid present within a well casing and through a production tubing is provided. The pumping system includes a housing coupled to the production tubing. The pumping system further includes a first pump coupled to the housing and having a first flow capacity and a second pump coupled to the housing and having a second flow capacity. The second flow capacity is different than the first flow capacity. A motor is coupled to the first pump and the second pump, wherein the motor is configured to selectively operate at least one of the first pump and the second pump based on a flow capacity of the fluid present within the well casing.

In another aspect, a well assembly for pumping a fluid from a well casing is provided. The well assembly includes a production zone. A first pump is coupled to the housing and has a first flow capacity. A second pump is coupled to the housing and has a second flow capacity which is less than the first flow capacity. A motor is coupled to the first pump and the second pump and configured to selectively operate at least one of the first pump and the second pump based on a flow capacity of the fluid present within the well casing.

In a further aspect, a method of assembling a pumping system within a well casing is provided. The method includes coupling a first pump having a first flow capacity to a housing. A second pump having a second flow capacity is coupled to the housing, wherein the second flow capacity is less than the first flow capacity. The method includes coupling a first flow control device to the housing and the first pump and coupling a second flow control device to the housing and the second pump. Further, the method includes coupling a motor to the first pump and the second pump, wherein the motor is configured to selectively operate at least one of the first pump and the second pump based on a flow capacity of a fluid present within the well casing.

DRAWINGS

These and other features, aspects, and advantages will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings. The singular forms "a", "an", and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The embodiments described herein relate to pumping systems and methods of pumping fluid from a well. The embodiments also relate to methods, systems and/or apparatus for controlling fluid flow during operation to facilitate improvement of well production performance. It should be understood that the embodiments described herein include a variety of types of well assemblies, and further understood that the descriptions and figures that utilize petroleum flow are exemplary only. The exemplary pumping system provides multiple pumps that are individually and selectively driven by a single motor. The pumping system provides a range of flow rates to efficiently operate the well assembly over extended periods of time.

Figure 1:
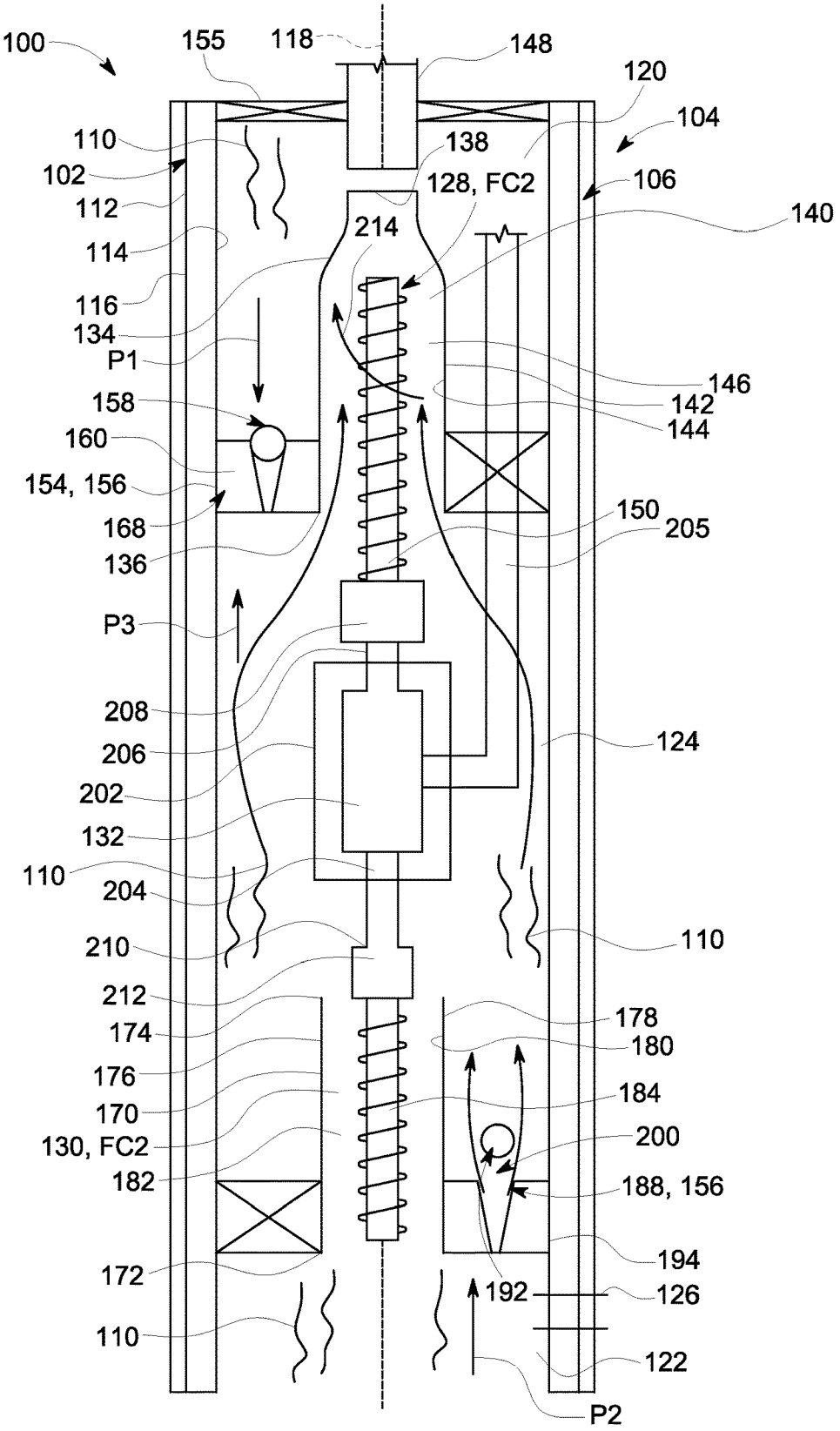
FIG. 1 is a side elevational view of an exemplary pumping system in a first operating condition coupled to a wellbore.

FIG. 1 is a side elevational view of a pumping system 100 coupled to a wellbore 102 in a first operating condition 104. Pumping system 100 is designed for deployment in a well 106 within a geological formation 108 containing desirable production fluids 110, such as, but not limited to, petroleum. Wellbore 102 is drilled into geological formation 108 and lined with a well casing 112. Well casing 112 includes an inner sidewall 114, an outer sidewall 116, and an axis 118 located within inner sidewall 114. A first zone 120, a second zone 122, and a third zone 124 of well casing 112 are located around axis 118. Alternatively, well casing 112 may be horizontally positioned within geological formation 108 with third zone 124 located between first zone 120 and second zone 122. Moreover, well casing 112 may be positioned in any orientation within geological formation 108 and may include any number of zones to enable pumping system 100 to function as described herein. A plurality of perforations 126 is formed through casing 112 to permit fluid 110 to flow into wellbore 102 from geological formation 108 and into second zone 122.

Pumping system 100 includes a first pump 128, a second pump 130, and a motor 132. First pump 128, second pump 130, and motor 132 are axially aligned with respect to each other within well casing 112 and along axis 118. Axial alignment of first pump 128, second pump 130, and motor 132 facilitates design efficiency and installation efficiency. Moreover, axial alignment of first pump 128, second pump 130, and motor 132 reduces wellbore diameter to facilitate decreasing boring costs. First pump 128 is submersible and has an inlet end 136, a discharge end 138, and a body 140 coupled to and extending between inlet end 136 and discharge end 138. Body 140 includes an outer surface 142 facing first zone 120 and an inner surface 144 defining a channel 146 between inlet end 136 and discharge end 138. Inlet end 136 is coupled in flow communication to third zone 124 and discharge end 138 is coupled in flow communication to a production tubing 148. Discharge end 138 and production tubing 148 are configured in flow communication with first zone 120. First pump 128 includes a first impeller 150 coupled to motor 132 and located within channel 146. In the exemplary embodiment, first pump 128 has a first flow capacity FC1 in a range between about 500 barrels per day ("BPD") and about 5000 BPD. Alternatively, first flow capacity FC1 can be less than about 500 BPD or more than about 5000 BPD. First flow capacity FC1 can include any flow range to enable first pump 128 to function as described herein.

Pumping system 100 includes a first packer 154 coupled to inner sidewall 114 and to first pump 128 near inlet end 136. First packer 154 includes an annular seal 156, such as, but not limited to, an O-ring, that isolates and/or seals first zone 120 from third zone 124. Pumping system 100 further includes a first flow control device 158 coupled to first packer 154 and in flow communication to first zone 120 and third zone 124. In the exemplary embodiment, first flow control device 158 is coupled to first packer 154 and near a first portion 160 of inner sidewall 114 of well casing 112. Alternatively, first flow control device 158 can be coupled to any location of first packer 154. In the exemplary embodiment, first flow control device 158 includes a one-way valve such as, but not limited to, a ball check valve, a swing check valve, and a diaphragm check valve. One-way valve 158 is in flow communication with first zone 120 and third zone 124 and can include any configuration to allow one-way fluid flow from third zone 124 and into first zone 120. In first operating condition 104, a first pressure P1 in first zone 120 is greater than a third pressure P3 in third zone 124 as described herein. One-way valve 158 is configured to move to a closed position 168 in response to the pressure differential between first pressure P1 and third pressure P3. In closed position 168, first zone 120 and third zone 124 are not in flow communication. Another packer 155 is coupled to inner sidewall 114 and to production tubing 148. Packer 155 isolates and/or seals first zone 120 from well bore 102.

Second pump 130 is submersible and includes an inlet end 172, a discharge end 174, and a body 176 coupled to and extending between inlet end 172 and discharge end 174. Body 176 includes an outer surface 178 facing third zone 124 and an inner surface 180 defining a channel 182 between inlet end 172 and discharge end 174. Inlet end 172 is coupled in flow communication to second zone 122 and discharge end 174 is coupled in flow communication to third zone 124. Second pump 130 includes a second impeller 184 coupled to motor 132 and located within channel 182. Second pump 130 has a second flow capacity FC2 which is different from first flow capacity FC1. In the exemplary embodiment, second flow capacity FC2 is less than first flow capacity FC1. Alternatively, second flow capacity FC2 can be substantially the same or greater than first flow capacity FC1. More particularly, second flow capacity FC2 has a flow range between about 50 barrels per day ("BPD") and about 500 BPD. Alternatively, second flow capacity FC2 can be less than about 50 BPD or more than about 500 BPD. Second flow capacity FC2 can include any flow range to enable second pump 130 to function as described herein.

Pumping system 100 includes a second packer 188 coupled to inner sidewall 114 and to second pump 130 near inlet end 172. Second packer 188 includes annular seal 156 such as, but not limited to, an O-ring that isolates and/or seals second zone 122 from third zone 124. Pumping system 100 further includes a second flow control device 192 coupled to second packer 188 and in flow communication to second zone 122 and third zone 124. In the exemplary embodiment, second flow control device 192 is coupled to second packer 188 and near a second portion 194 of well casing 112. Alternatively, second flow control device 192 can be coupled to any location of second packer 188. In the exemplary embodiment, second flow control device 192 includes a one-way valve such as, but not limited to, a ball check valve, a swing check valve, and a diaphragm check valve. One-way valve 192 is in flow communication with second zone 122 and third zone 124 and can include any configuration to allow one-way fluid flow from second zone 122 and into third zone 124. In first operating condition 104, second pressure P2 in second zone 122 is less than a third pressure P3 in third zone 124 as described herein. One-way valve 192 is configured to move to an open position 200 in response to the pressure differential between second pressure P2 and third pressure P3. In open position 200, second zone 122 and third zone 124 are in flow communication.

Motor 132 is located within third zone 124, and in particular, between first flow control device 158 and second flow control device 192. In the exemplary embodiment, a motor protector 202 such as, but not limited to, a seal, a diaphragm, cover, and/or a shroud encloses motor 132 to isolate motor 132 from fluid 110 present in third zone 124. Moreover, motor 132 is coupled to first pump 128 and second pump 130. More particularly, motor 132 includes a shaft 204 having a first end 206 that is coupled to a first clutch 208. First clutch 208 is coupled to first impeller 150. Shaft 204 further includes a second end 210 that is coupled to a second clutch 212. Second clutch 212 is coupled to second impeller 184. Power cables 205 are coupled to motor 132 and to a power source (not shown) and/or a controller (not shown). In the exemplary embodiment, power cables 205 pass through first packer 154 through a seal (not shown). Motor 132 individually and selectively operates first pump 128 and second pump 130 as described herein.

During an exemplary operation of pumping system 100 during first operating condition 104, first clutch 208 engages motor shaft 204 to first impeller 150. Motor 132 transmits torque to first clutch 208 which rotates first impeller 150 in a first direction 214, such as, for example, a counter-clockwise direction. During first operating condition 104, second clutch 212 disengages motor shaft 204 from second impeller 184 to allow free rotation of shaft second end 210 and prevent torque transfer from motor 132 and to second impeller 184. Accordingly, during first operating condition 104, second impeller 184 is immobilized. First impeller 150 is configured to draw fluid 110 from third zone 124 and into inlet end 136. First impeller 150 is further configured to increase the pressure of fluid 110 as fluid 110 moves through body 140 and out of discharge end 138. Upon exiting discharge end 138, fluid 110 has first pressure P1 in first zone 120 which is greater than third pressure P3 in third zone 124. Accordingly, higher first pressure P1 is configured to move first flow control device 158 to closed position 168. In closed position 168, first flow control device 158 prevents fluid 110 from returning from first zone 120 and into third zone 124. Discharged fluid 110 in first zone 120 is driven out of first zone 120 by first pump 128 and into a reservoir (not shown) or a storage facility (not shown).

Moreover, in first operating condition 104, as first pump 128 draws fluid 110 from second zone 122, second pressure P2 in second zone 122 is higher than third pressure P3 in third zone 124. Accordingly, higher second pressure P2 in second zone 122 is configured to move second flow control device 192 to open position 200. In open position 200, first pump 128 is configured to draw fluid 110 from second zone 122, through second flow control device 192 and into third zone 124. Second flow control device 192 provides a by-pass for fluid 110 to flow around second pump 130 for subsequent discharge of fluid 110 into third zone 124. First pump 128 continues to move fluid 110 from third zone 124, through body 140 and out of discharge end 138 to repeat the flow process.

Figure 2:
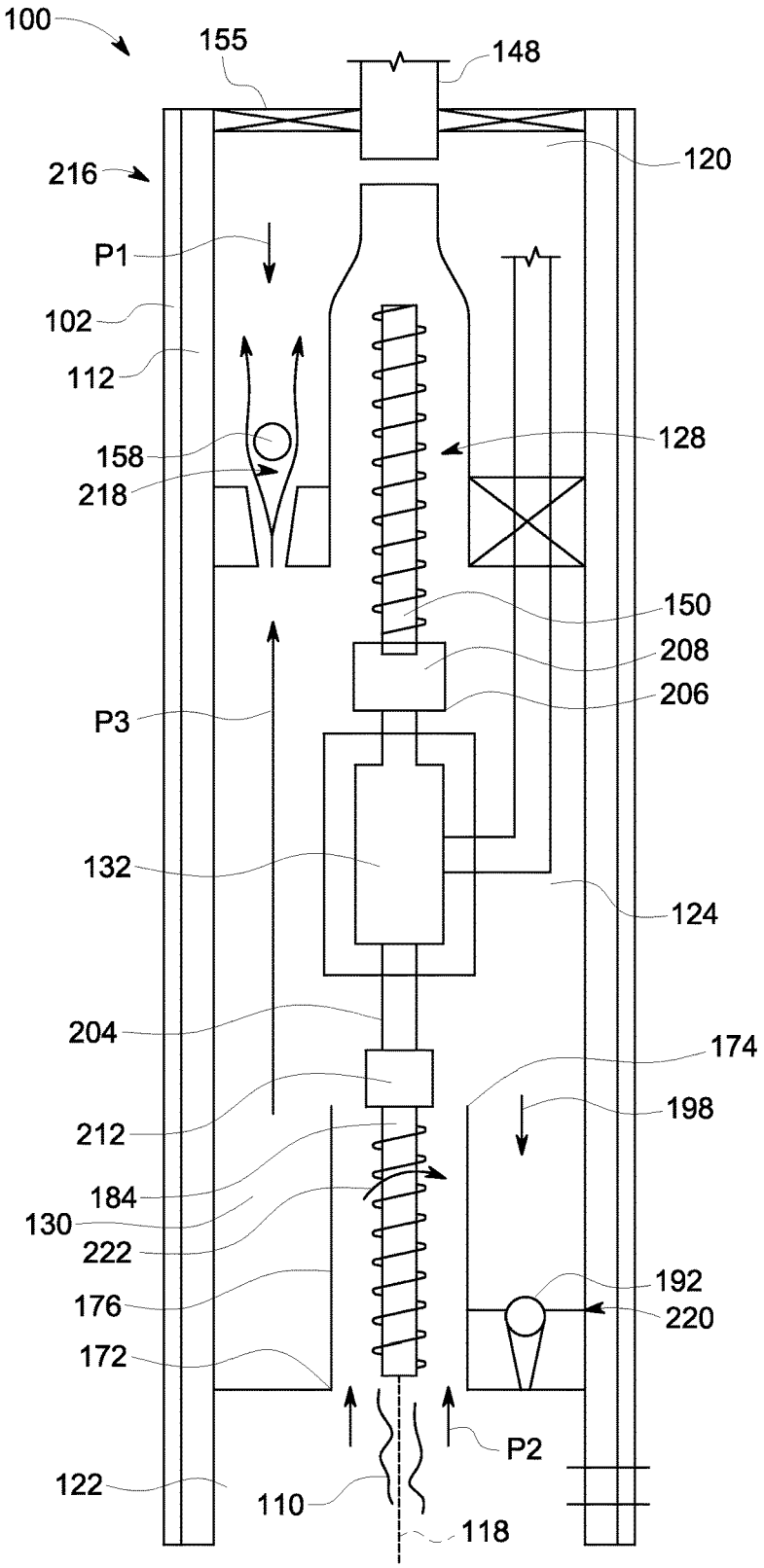
FIG. 2 is a side elevational view of the pumping system shown in FIG. 1 in a second operating condition.

FIG. 2 is a side elevational view of pumping system 100 shown in a second operating condition 216. In second operating condition 216, third pressure P3 in third zone 124 is greater than first pressure P1 in first zone 120 as described herein. First flow control device 158 is configured to move to an open position 218 in response to the pressure differential between third pressure P3 and second pressure P2. In open position 218, first zone 120 and third zone 124 are in flow communication. Moreover, third pressure P3 in third zone 124 is greater than second pressure P2 in second zone 122 as described herein. Second flow control device 192 is configured to move to a closed position 222 in response to the pressure differential between third pressure P3 and second pressure P2. In closed position 220, second zone 122 and third zone 124 are not in flow communication.

During an exemplary operation of pumping system 100 during second operating condition 216, second clutch 212 engages motor shaft 204 to second impeller 184. Motor 132 transmits torque to second clutch 212 which rotates second impeller 184 in a second direction 222 such as, for example, a clockwise direction. During operation, second direction 222 is opposite of first direction 214. Alternately, second direction 222 can be the same as first direction 214. During second operating condition 216, first clutch 208 disengages shaft first end 206 from first impeller 150 to allow free rotation of shaft first end 206 and prevent torque transfer from motor 132 and to first impeller 150. Accordingly, during second operating condition 216, first impeller 150 is immobilized. Second impeller 184 is configured to draw fluid 110 from second zone 122 and into inlet end 172. Second impeller 184 is further configured to increase the pressure of fluid 110 as fluid 110 moves through body 176 and out of discharge end 174. Upon exiting discharge end 174, fluid 110 has third pressure P3 in third zone 124 which is greater than second pressure P2 in second zone 122. Accordingly, higher third pressure P3 is configured to move second flow control device 192 to closed position 220. In closed position 220, second flow control device 192 prevents fluid 110 from returning from third zone 124 and into second zone 122.

Moreover, in second operating condition 216, third pressure P3 in third zone 124 is greater than first pressure P1 in first zone 120. Accordingly, higher third pressure P3 in third zone 124 is configured to move first flow control device 158 to open position 218. In open position 218, second pump 130 is configured to move fluid 110 from third zone 124, through second flow control device 192 and into first zone 120 via open first flow control device 158. First flow control device 158 provides a by-pass route for fluid 110 to flow around first pump 128 for subsequent discharge out of well casing 112 and into a reservoir (not shown) or a storage facility (not shown). Second pump 130 continues to move fluid 110 from second zone 122, through inlet end 172 and body 176 and out of discharge end 174 to repeat the flow process.

Figure 3:
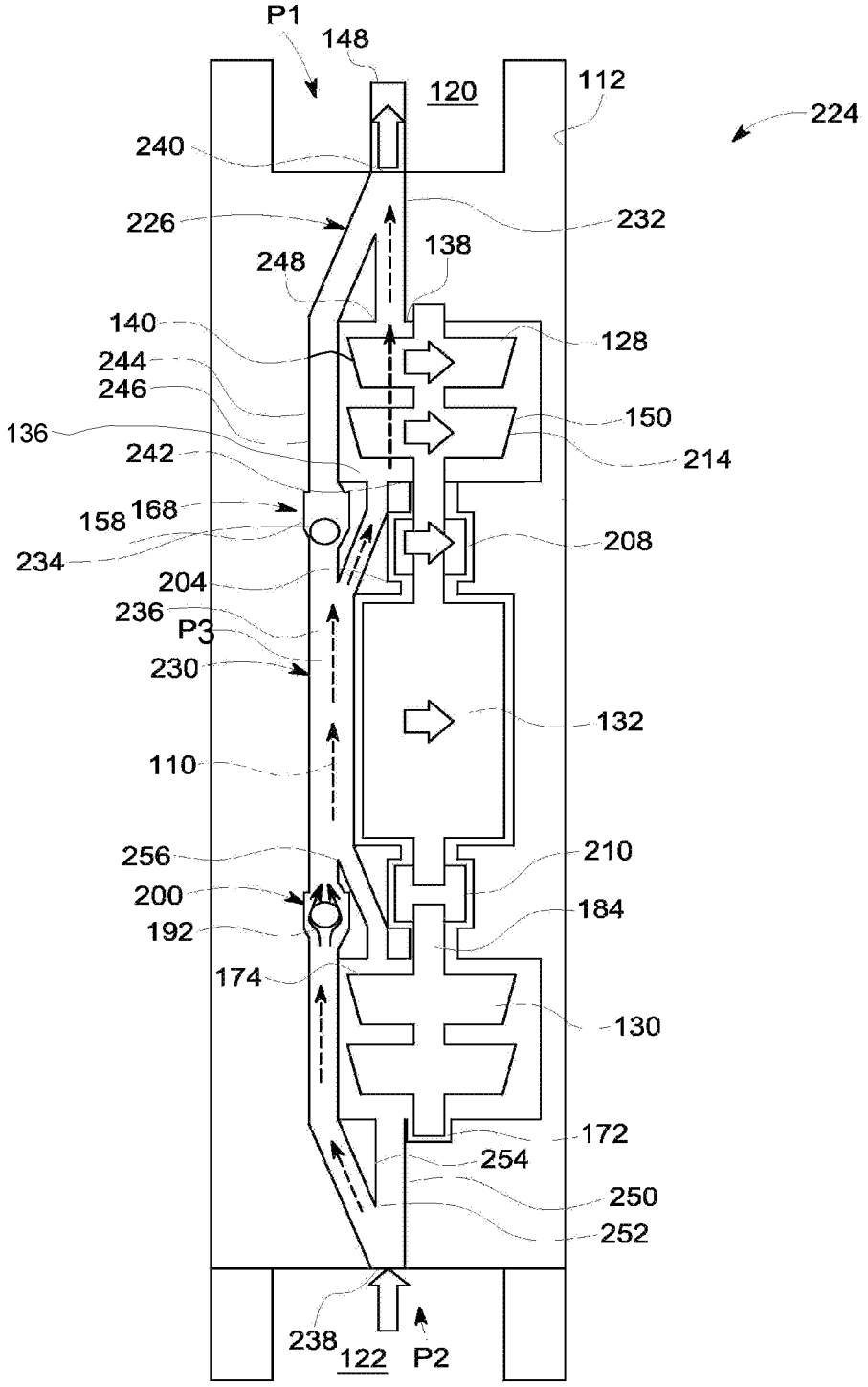
FIG. 3 is a side elevational view of another exemplary pumping system in a first operating condition.
Figure 4:
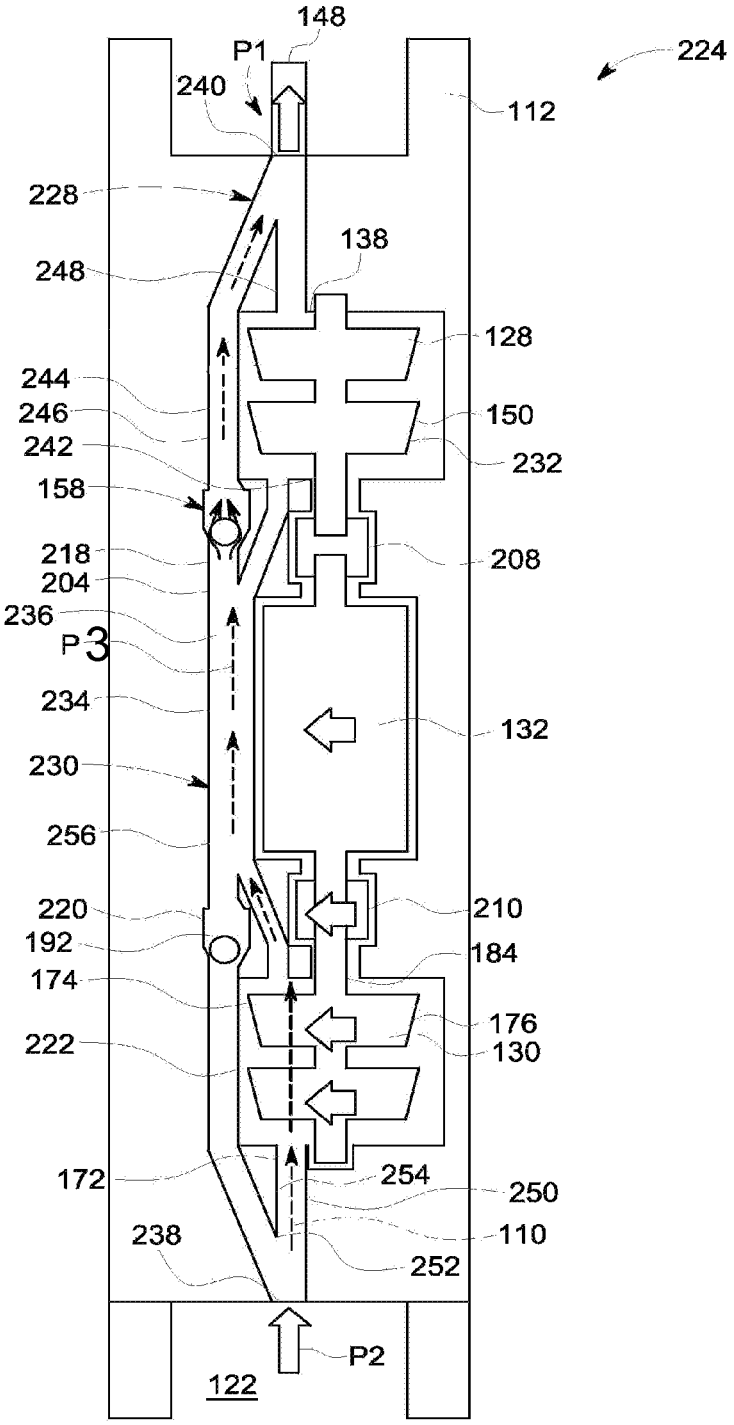
FIG. 4 is a side elevational view of the pumping system shown in FIG. 3 in a second operating condition.

FIG. 3 is a side elevational view of another exemplary pumping system 224 in a first operating condition 226. FIG. 4 is a side elevational view of pumping system 224 in a second operating condition 228. In FIGS. 3 and 4, same element numbers are used to denote same components as shown in FIGS. 1 and 2. Pumping system 224 includes a self-contained, one-piece assembly 230. Assembly 230 includes a housing 232 that is coupled in flow communication to production tubing 148 and configured in flow communication with well casing. Housing 232 encloses first pump 128, second pump 130, and motor 132. Housing 232 also encloses motor shaft 204, first clutch 208, and second clutch 212. In the exemplary embodiment, housing 232 is coupled to production tubing 148 and suspends within well casing 12. Housing 232 isolates and/or seals first pump 128, second pump 130, motor 132, motor shaft 204, first clutch 208, and second clutch 212 from fluid 110 present in well casing 112.

In the exemplary embodiment, assembly 230 includes a primary conduit 234 defining a primary flow path 236 for fluid 110. Primary conduit 234 includes an inlet end 238 coupled in flow communication to second zone 122 and an outlet end 240 coupled in flow communication to first zone 120. Assembly 230 includes a first conduit 242 coupled to and in flow communication to primary conduit 234 and defining a first flow path 244. First conduit 242 includes an inlet end 246 coupled to primary conduit 234 and upstream from first flow control device 158. Inlet end 246 is also coupled in flow communication to inlet end 136 of first pump 128. First conduit 242 includes an outlet end 248 coupled in flow communication to primary conduit 234 and downstream of first flow control device 158. Outlet end 248 is also coupled in flow communication to discharge end 138 of first pump 128.

Assembly 230 further includes a second conduit 250 coupled in flow communication to primary conduit 234 and defining a second flow path 252. More particularly, second conduit 250 includes an inlet end 254 coupled to primary conduit 234 and upstream of second flow control device 192. Inlet end 254 is also coupled in flow communication to inlet end 172 of second pump 130. Second conduit 250 includes an outlet end 256 coupled in flow communication to primary conduit 234 and downstream of second flow control device 192. Outlet end 256 is also coupled in flow communication to discharge end 174 of second pump 130.

During an exemplary operation of pumping system 224 during first operating condition 226, first clutch 208 engages motor shaft 204 to first impeller 150. Motor transmits torque to first clutch 208 which rotates first impeller 150 in first direction 214. During first operating condition 226, second clutch 212 disengages motor shaft 204 from second impeller 184 to allow free rotation of shaft second end 210 and prevent torque transfer from motor 132 and to second impeller 184. Accordingly, during first operating condition 226, second impeller 184 is immobilized. First impeller 150 is configured to draw fluid 110 from primary conduit 234 and into first conduit 242. First impeller 150 is further configured to increase the pressure of fluid 110 as fluid 110 moves from first conduit 242, through body 140 and out of discharge end 138. Upon exiting discharge end 138, fluid 110 has first pressure P1 in first zone 120 which is greater than pressure P in primary conduit 234. Accordingly, higher first pressure P1 is configured to move first flow control device 158 to closed position 168. In closed position 168, first flow control device 158 prevents fluid 110 from returning from first zone 120 and into primary conduit 234. Discharged fluid 110 in first zone 120 is driven out of first zone 120 by first pump 128 and into a reservoir (not shown) or a storage facility (not shown).

Moreover, in first operating condition 226, as first pump 128 draws fluid 110 from second zone 122, second pressure P2 in second zone 122 is higher than pressure P in primary conduit 234. Accordingly, higher second pressure P2 in second zone 122 is configured to move second flow control device 192 to open position 200. In open position 200, first pump 128 is configured to draw fluid 110 from second zone 122, through second flow control device 192 and into primary conduit 234. Second flow control device 192 provides a by-pass around second pump 130 for subsequent discharge of fluid 110 into primary conduit 234. First pump 128 moves fluid 110 from primary conduit 234 and into first conduit 242. First pump 128 continues to move fluid 110 from first conduit 242, through body 140 and out of discharge end 138 to repeat the flow process.

FIG. 4 is a side elevational view of pumping system 224 100 shown in second operating condition 228. In second operating condition 228, pressure P in primary conduit 234 is greater than first pressure P1 in first zone 120 as described herein. First flow control device 158 is configured to move to an open position 218 in response to the pressure differential between pressure P and first pressure P1. In open position 218, first zone 120 and primary conduit 234 are in flow communication. Moreover, pressure P in primary conduit 234 is greater than second pressure P2 in second zone 122 as described herein. Second flow control device 192 is configured to move to a closed position 222 in response to the pressure differential between pressure P and second pressure P2.

During an exemplary operation of pumping system 224 during second operating condition 228, second clutch 212 engages motor shaft 204 to second impeller 184. Motor 132 transmits torque to second clutch 212 which rotates second impeller 184 in a second direction 222. During operation, second direction 222 is opposite of first direction 214. Alternately, second direction 222 can be the same as first direction 214. During second operating condition 228, first clutch 208 disengages shaft first end 206 from first impeller 150 to allow free rotation of shaft first end 206 and prevent torque transfer from motor 132 and to first impeller 150. Accordingly, during second operating condition 228, first impeller 150 is immobilized. Second impeller 184 is configured to draw fluid 110 from second zone 122 and into second conduit 250. Second impeller 184 is further configured to increase the pressure of fluid 110 as fluid 110 moves from second conduit 250, through body 176 and out of discharge end 174. Upon exiting discharge end 174, fluid 110 has pressure P in primary conduit 234 which is greater than second pressure P2 in second zone 122. Accordingly, higher pressure P is configured to move second flow control device 192 to closed position 220. In closed position 220, second flow control device 192 prevents fluid 110 from returning from primary conduit 234 and into second zone 122.

Moreover, in second operating condition 228, pressure P in primary conduit 234 is greater than first pressure P1 in first zone 120. Accordingly, higher pressure P in primary conduit 234 is configured to move first flow control device 158 to open position 218. In open position 218, second pump 130 is configured to move fluid 110 from primary conduit 234, through second flow control device 192 and into first zone 120 via open first flow control device 158. First flow control device 158 provides a by-pass route for fluid 110 to flow around first pump 128 for subsequent discharge out of well casing 112 into a reservoir (not shown) or a storage facility (not shown). Second pump 130 continues to move fluid 110 from second zone 122 and through second conduit 250. More particularly, second pump 130 continues to move fluid 110 through body 176 and out of discharge end 174 to repeat the flow process.

During exemplary operations, motor 132 individually and selectively operates at least one of first pump 128 and second pump 130 based on a flow capacity of fluid 110 present in well casing 112. Alternatively, motor 132 can individually and selectively operate at least one of first pump 128 and second pump 130 based on a volume amount of fluid 110 present in well casing 112. A sensor (not shown) such as a pressure sensor, level sensor and/or a flow rate sensor, can send signals to a controller (not shown) to control motor 132. When well casing 112 experiences large amounts of fluid 110 being transferred from geological formation 108 (shown in FIG. 1) and into well casing 112 (shown in FIG. 1) through perforations 126 (shown in FIG. 1), such as during an initial well operation time period, first clutch 208 engages motor shaft 204 and rotates first pump 128. Moreover, second clutch 212 disengages motor shaft 204 from second pump 130. First pump 128 includes a larger flow capacity as compared to second pump 130 to move larger volume amounts of fluid 110 out of well casing 112. During large amounts of fluid flow, first pump 128 can operate at first flow capacity FC1 (shown in FIG. 1) and discharge fluid 110 in a range between about 500 bpd and about 5000 bpd. During other operating times, second clutch 212 engages motor shaft 204 and rotates second pump 130 and first clutch 208 disengages motor shaft 204 from first pump 128. During normal or below normal amounts of fluid flow, second pump 130 can operate at second flow capacity FC2 (shown in FIG. 2) and discharge fluid 110 in a range between about 50 bpd and about 500 bpd. Second pump 130 includes a lower flow capacity as compared to first pump 128 to move smaller volume amounts of fluid 110 out of well casing 112. Accordingly, second pump 130, which is less costly to manufacture, install, operate, maintain, repair and/or replace can run during longer periods of time as compared to first pump 128.

Figure 5:
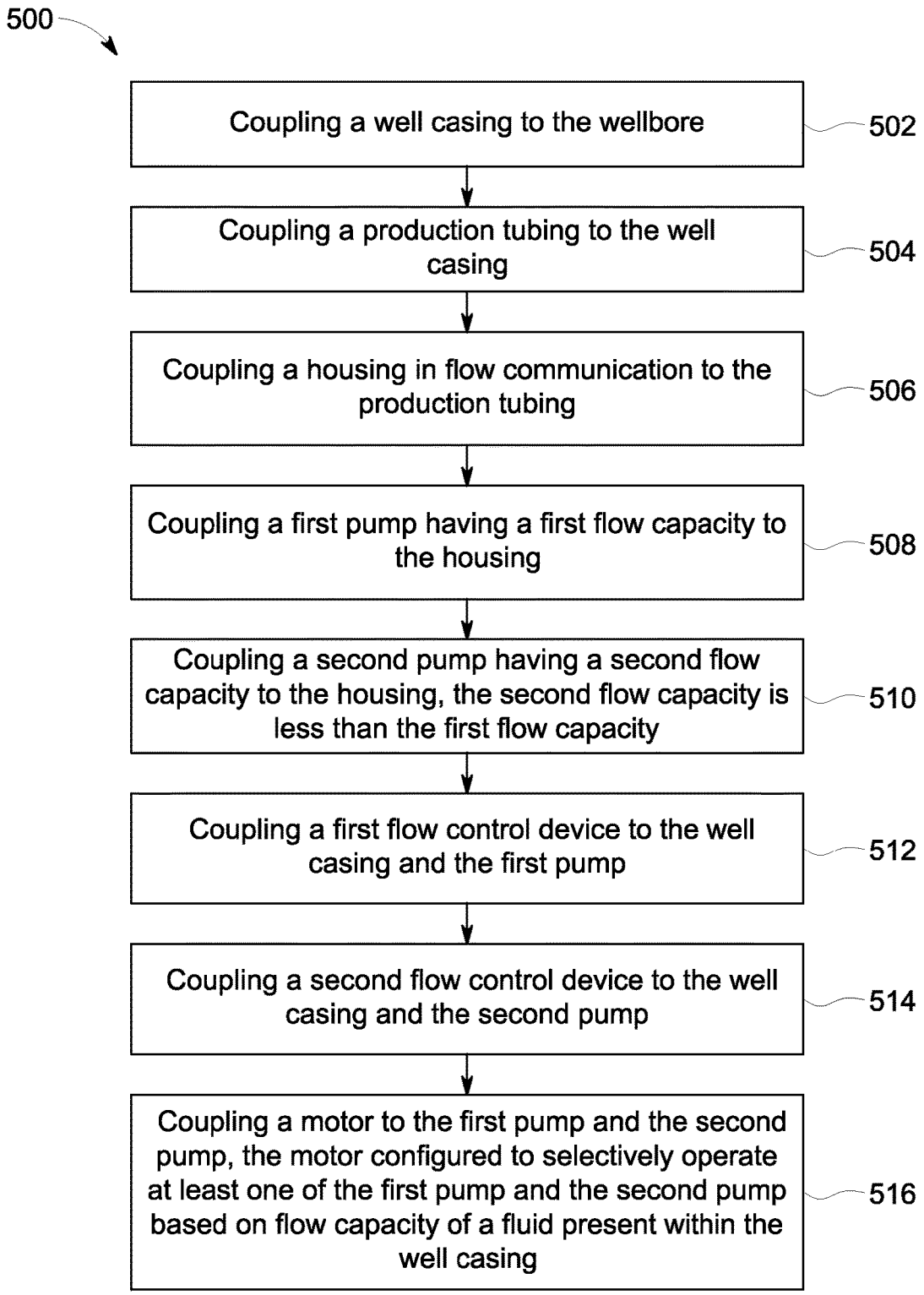
FIG. 5 is a flowchart illustrating an exemplary method of assembling the pumping system shown in FIG. 1.

FIG. 5 is a flowchart illustrating an exemplary method 500 of assembling a pumping system, such as pumping system 224 (shown in FIGS. 3 and 4) within well casing 122 (shown in FIG. 3). Method 500 includes coupling 502 well casing 112 (shown in FIG. 3) to wellbore 102 (shown in FIG. 1). Method 500 includes coupling 504 production tubing 148 to well casing. Housing 232 is coupled 506 in flow communication to production tubing. First pump 128 (shown in FIG. 3), which has first flow capacity FC1 (shown in FIG. 3), is coupled 508 to the housing. Second pump 130 (shown in FIG. 1), which has second flow capacity FC2 (shown in FIG. 1), is coupled 510 to the housing. In the exemplary method 500, the second flow capacity is less than the first flow capacity.

Method 500 includes coupling 512 first flow control device 158 (shown in FIG. 3) to the housing and the first pump. Moreover, method 500 includes coupling 514 second flow control device 192 (shown in FIG. 4) to the second pump. Motor 132 (shown in FIG. 3) is coupled 510 to the first pump and the second pump. In the exemplary embodiment, the motor is coupled in axial alignment with the first pump and the second pump. Moreover, in the exemplary method 500, the motor is configured to selectively operate at least one of the first pump and the second pump based on a flow capacity and/or a volume amount of fluid 110 (shown in FIG. 1) present within the w.

Method 500 further includes coupling first clutch 208 (shown in FIG. 3) to the motor and the first pump. Second clutch 212 (shown in FIG. 3) is coupled to the motor and the second pump. Moreover, in the exemplary method 500, first packer 154 (shown in FIG. 1) is coupled to the well casing and the housing and second packer 188 (shown in FIG. 1) is coupled to the well casing and the housing.

Figure 6:
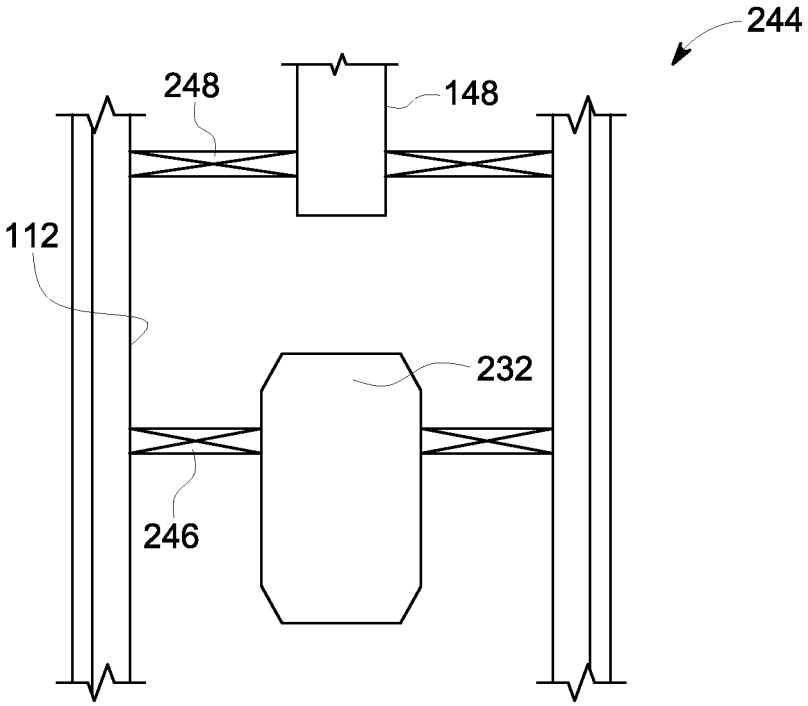
FIG. 6 is a side elevational view of another exemplary pumping system.

FIG. 6 illustrates a side elevational view of another exemplary pumping system 244. In FIG. 6, same element numbers are used to denote same components shown in FIGS. 1-5. Pumping system 244 includes housing 232 which is separated from production tubing 148. A packer 246 couples housing 232 to well casing 112. In the exemplary embodiment, housing 232 suspends within well casing 112 and in flow communication with production tubing 148.

The exemplary embodiments described herein facilitate increasing efficiency and reducing costs for pumping a fluid from a well. The exemplary embodiments described herein produce the fluid from the well at an efficient recovery rate during an initial high flow rate in the early phase of well life and then producing the fluid from the well at an efficient rate a lower flow rate one or more times over the life of the well. The embodiments describe axially aligning a first pump, a second pump, and a motor for efficient installation and operation of a well assembly and selectively operating at least one of the first pump and the second pump by the motor and based on a volume amount of fluid present within a well casing. Moreover, the exemplary embodiments described herein facilitate reducing design, manufacturing, installation, operational, maintenance costs, and/or replacement costs for a pumping system.

A technical effect of the systems and methods described herein includes at least one of: (a) axially aligning a first pump, a second pump, and a motor for efficient installation and operation of a well assembly; (b) selectively operating at least one of a first pump and a second pump by a motor and based on a volume amount of fluid present within a well casing; (c) discharging a first flow rate of fluid during an early phase of a well life and discharging a different and second flow rate of fluid during other phases of a well life; (d) efficiently discharging fluids from different well zones over a range of flow rates; and, (e) decreasing design, installation, operational, maintenance, and/or replacement costs for a well assembly.

Exemplary embodiments of a pumping and methods for assembling a pumping system are described herein. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment may be implemented and utilized in connection with many other fluid applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pumping system for use in moving a fluid present within a well casing and through a production tubing, said pumping system comprising:

the well casing coupled to the production tubing;

a first pump having a pump body disposed within a first zone of the well casing, the first pump in fluid communication with the production tubing and having a first flow capacity, a second pump having a pump body disposed within a third zone of the well casing, the second pump having a second flow capacity which is different than the first flow capacity;

a motor disposed within the third zone of the well casing, the motor coupled to said first pump and said second pump, wherein said motor selectively operates one of said first pump or said second pump based on a flow capacity of the fluid present within the well casing;

a first flow control device coupled to said first pump and, a second flow control device coupled to said second pump, the first flow control device disposed to provide one-way flow from the third zone to the first zone and the second flow control device disposed to provide one-way flow from a second zone of the well casing to the third zone;

a first packer directly coupled to said first flow control device, said pump body of said first pump and said well casing, said first packer isolating said first zone from said third zone;

a second packer directly coupled to said second flow control device, said pump body of said second pump and said well casing, said second packer isolating said second zone from said third zone; and a third packer directly coupled to said well casing and said production tubing, the third packer isolating said first zone from said wellbore, wherein said third zone is located between said first zone and said second zone, wherein said motor comprises a first, one-way clutch coupled to said first pump and a second, one-way clutch coupled to said second pump;

wherein said first, one-way clutch rotates said first pump in a first direction during a first operating condition and said second, one-way clutch disengages said second pump during the first operating condition, wherein said first, one-way clutch disengages said first pump during a second operating condition and said second, one-way clutch rotates said second pump in a second direction during the second operating condition, wherein said first direction is opposite said second direction, and wherein said first pump, said second pump and said motor are in axial alignment within the well casing.

2. The pumping system of claim 1, wherein said first flow capacity has a range between 500 barrels per day and 5000 barrels per day.

3. The pumping system of claim 1, wherein said second flow capacity has a range between 50 barrels per day and 500 barrels per day.

4. The pumping system of claim 1, wherein said first flow control device moves to a closed position during the first operating condition and said second flow control device moves to an open position during the first operating condition.

5. The pumping system of claim 4, wherein, said first flow control device moves to an open position during the second operating condition and said second flow control device moves to a closed position during the second operating condition.

6. A well assembly for pumping a fluid from a well casing, said well assembly comprising:

a production tubing coupled to the well casing;

a first pump having a pump body disposed within a first zone of the well casing, the first pump in fluid communication with the production tubing and having a first flow capacity;

a second pump having a pump body disposed within a third zone of the well casing, the second pump having a second flow capacity which is less than the first flow capacity;

a motor disposed within the third zone of the well casing, the motor coupled to said first pump and said second pump, wherein said motor selectively operates one of said first pump or said second pump based on a flow capacity of the fluid present within the well casing;

a first flow control device coupled to said first pump and a second flow control device coupled to said second pump, the first flow control device disposed to provide one-way flow from the third zone to die first zone and the second flow control device disposed to provide one-way flow from a second zone of the well casing to the third zone;

a first packer directly coupled to said first flow control device, said pump body of said first pump and said well casing, said first packer isolating said first zone from said third zone;

a second packer directly coupled to said second flow control device, said pump body of said second pump and said well casing, said second packer isolating said second zone from said third zone; and a third packer directly coupled to said well casing and said production tubing, the third packer isolating said first zone from said well bore, wherein said third zone is located between said first zone and said second zone, wherein said first pump rotates in a first direction during a first operating condition and said second pump is disengaged during the first operating condition, wherein said first pump is disengaged during a second operating condition and said second pump rotates in a second direction during the second operating condition, wherein said first direction is opposite said second direction, and wherein said first pump, said second pump, and said motor are axially aligned within the well casing.

7. The well assembly of claim 6, wherein said motor is located between said first flow control device and said second flow control device.

8. The well assembly of claim 6, further comprising a first conduit coupled to said first pump, a second conduit coupled to said second pump, and a primary conduit coupled to said first pump and said second pump.

9. A method of assembling a pumping system within a well casing, said method comprising:

disposing a first pump having a pump body and a first flow capacity within a first zone of the well casing;

disposing a second pump having a pump body and a second flow capacity within a third zone of the well casing, wherein the second flow capacity is less than the first flow capacity;

coupling a first flow control device to the well casing and the first pump, the first flow control device disposed to provide one-way flow from the third zone to the first zone;

coupling a second flow control device to the well casing and the second pump, the second flow control device disposed to provide one-way flow from a second zone of the well casing to the third zone;

coupling a motor to the first pump and the second pump, the motor disposed within the third zone of the well casing, wherein the motor selectively operates one of the first pump or the second pump based on a flow capacity of a fluid present within the well casing;

coupling the motor in axial alignment with the first pump and the second pump;

coupling a first clutch to the motor and the first pump and a second clutch to the motor and the second pump;

directly coupling a first packer to the pump body of said first pump, the well casing and the first flow control device to isolate the first zone from the third zone;

directly coupling a second packer to the pump body of said second pump, the well casing and the second flow control device to isolate the second zone from the third zone; and directly coupling a third packer to the well casing and a production tubing to isolate the first zone from the well bore;

wherein said third zone is located between said first zone and said second zone, wherein said first pump rotates in a first direction during a first operating condition and said second pump is disengaged during the first operating condition, wherein said first pump is disengaged during a second operating condition and said second pump rotates in a second direction during the second operating condition, and wherein said first direction is opposite said second direction.

* * * * *